US006986684B1

(12) United States Patent
Lien

(10) Patent No.: US 6,986,684 B1
(45) Date of Patent: Jan. 17, 2006

(54) INTERNAL STRUCTURE FOR CONNECTOR WITH COIL POSITIONING SEATS

(75) Inventor: Wen-Fu Lien, Tao Yuan Shien (TW)

(73) Assignee: Superworld Electronics Co., Ltd., Tao Yuan Shien (TW)

( * ) Notice: Subject to any disclaimer, the term of this patent is extended or adjusted under 35 U.S.C. 154(b) by 0 days.

(21) Appl. No.: 10/984,774

(22) Filed: Nov. 10, 2004

(51) Int. Cl.
*H01R 13/66* (2006.01)

(52) U.S. Cl. ..... 439/620

(58) Field of Classification Search ..... 439/620, 439/676, 490, 940
See application file for complete search history.

(56) References Cited

U.S. PATENT DOCUMENTS 4,754,370 A * 6/1988 DeTizio et al. ..... 361/772
4,789,847 A * 12/1988 Sakamoto et al. ..... 333/185
5,069,641 A * 12/1991 Sakamoto et al. ..... 439/620
5,587,884 A * 12/1996 Raman ..... 361/728
5,687,233 A * 11/1997 Loudermilk et al. ..... 379/442
5,736,910 A * 4/1998 Townsend et al. ..... 333/181
5,833,496 A * 11/1998 Hollander et al. ..... 439/620
6,102,741 A * 8/2000 Boutros et al. ..... 439/620
6,319,064 B1 * 11/2001 Belopolsky et al. ..... 439/620
6,474,999 B1 * 11/2002 Givens et al. ..... 439/76.1
6,761,595 B1 * 7/2004 Zheng et al. ..... 439/676
6,773,298 B2 * 8/2004 Gutierrez et al. ..... 439/490
6,773,302 B2 * 8/2004 Gutierrez et al. ..... 439/541.5
6,811,442 B1 * 11/2004 Lien et al. ..... 439/620

* cited by examiner

*Primary Examiner*—Gary Paumen
*Assistant Examiner*—Larisa Tsukerman
(74) *Attorney, Agent, or Firm*—Troxell Law Office, PLLC

(57) ABSTRACT

An internal structure for a connector with at least a nest-typed positioning seat that is covered with a metallic housing to form a communication connector, and has a connecting board having thereon metallic guide pins and having thereon a circuit board assembly with a resistance-capacitance (RC) element and comprising a first and a second circuit board, each positioning seat is provided between the first and the second circuit boards for receiving coils; connecting lines of the coils are pulled to one side of the seat to connect the assembly, an object of connecting the coils with the circuit board assembly thus is easily attained. Each nest is provided on its periphery with slits of different depths, connecting lines of the coils can be extended through the slits to make electric connecting with the assembly. Thereby a function of wave filtering and abnormal voltage isolating is obtained.

7 Claims, 5 Drawing Sheets

INTERNAL STRUCTURE FOR CONNECTOR WITH COIL POSITIONING SEATS

BACKGROUND OF THE INVENTION

1. Field of the Invention

The present invention is related to an internal structure of a connector with at least a coil positioning seat, and especially to an internal structure of a connector of which coils are received in the coil positioning seat to make easy of connection with a circuit board.

2. Description of the Prior Art

In the internal structure of an electric communication connector, a plurality of coils must be provided on an electric circuit board to get the function of wave filtering and abnormal voltage isolating. Particularly for the present time, eight pins in a high-speed communication connector will all be used, thereby there must be eight coils provided for each high-speed communication connector; the number of pins is larger than that requested before. In a conventional internal structure, coils are randomly assembled on a printed circuit board in a floating sticking mode, such a mode of processing renders the lower ones of the coils to be not accurately positioned, thus the feature of an article resulted is unstable and it is worriable that there is latent quality blemish. And one thing even more cumbersome, the work of connecting of the eight coils with the circuit board is quite difficult; assembling of a conventional technical structure must be done by a skillful technician to complete, it is time consuming and not benefit to production, thereby the conventional technical structure has to be improved.

The present invention is pertinent to a U.S. patent application Ser. No. 10/732,293 which has been approved for granting a certificate of patent right and has a corresponding R.O.C. utility model application No. 92,216,829 and titled "POSITIONING SEAT WITH NETS FOR COILS FOR A CONNECTOR" belonging to the same applicant as that of the present application.

In these preceding applications, a positioning seat with nests for coils for a connector is provided, the internal structure of an electric communication connector has a printed circuit board having a resistance-capacitance (RC) element, the printed circuit board is connected thereon with a plurality of coils for wave filtering and abnormal voltage isolating; in this structure, the plural coils are positioned by a positioning device formed from the seat and a lateral connecting plate connectable with the seat as well as connecting in advance with metallic guide needles; the seat is shaped in advance to have a plurality of nests mutually spaced away and in an amount same as that of the coils; so that every coil can be placed in a nest in advance for using in the operation of electric connecting with related members and the printed circuit board. Wherein each nest can be provided with slits with different depths on the top surface near the periphery of the nest, between a nest and the other, and between each nest and an external edge of the seat in pursuance of the mode of electric connecting required.

With such a structure of these preceding applications, the feature and quality of its products are more stable and reliable; and processing of such a connector is simplified, dependence of the processing quality of its products on the skillfulness of operators is largely reduced and thus cost of production can be lowered; further, examination of its semi-finished products is easy and cost of working hours can be lowered, quality of mass production of the connector on its production line can be elevated, and the connector is suitable for mass production with divisional stages in processing to increase the efficiency of production.

However, the connector is applied mainly to connection in electric communication, with increasing speed of communication transmitting and receiving at the present time such as by using broadband, to render all the eight pins of the connector to have to be used; relatively, the number of coils provided for the connector must be increased to eight. The structure as disclosed in the preceding applications is unable to be provided with more coils; thereby the connector has to be improved.

SUMMARY OF THE INVENTION

The present invention provided for a connector has an internal structure with at least a coil positioning seat, the structure has a circuit board assembly designed to include two mutually separated (a first and a second) circuit boards; the positioning seat is provided in an interspace between the first and the second circuit boards and has therein a plurality of coils; all the connecting lines of the coils are pulled to one side of the positioning seat in advance to be connected with the circuit board assembly, so that an object of connecting the coils with the circuit board assembly is very easy attained.

The present invention further uses a plurality of positioning seats with nests, each positioning seat has a surface on an outer side thereof shaped in advance to have a plurality of mutually spaced nests mating in number with the coils; wherein two nest-typed positioning seats are provided between a first and a second circuit board; and the coils are respectively mounted in the mutually spaced nests, they are connected with a circuit board assembly via slits on surfaces of the positioning seats, so that the entire connector has the function of wave filtering and abnormal voltage isolating.

The main object of the present invention is to provide an internal structure of a connector with at least a coil positioning seat, each coil can be easily mounted in a nest of a coil positioning seat, and each coil is effectively isolated to surely get an effect of protection.

Another object of the present invention is to provide an internal structure of a connector with at least a coil positioning seat; by having a first and a second circuit board both perpendicular to a lateral connecting board and two positioning seats allocated between the first and the second circuit boards, the internal structure basically has a cubic contour, and is very easily to be fixed on the lateral connecting board, this can save much working hours and lower the cost of production.

The present invention will be apparent in its structure and features after reading the detailed description of the preferred embodiment thereof in reference to the accompanying drawings.

DETAILED DESCRIPTION OF THE PREFERRED EMBODIMENT

Referring to FIGS. 1–4 showing the arrangement of a nest-typed positioning seat, the connector used for the present invention has therein an internal structure 10 having a plurality of positioning seats to separate coils; the internal structure 10 is covered with a metallic housing 30 to form a communication connector.

Figure 1:
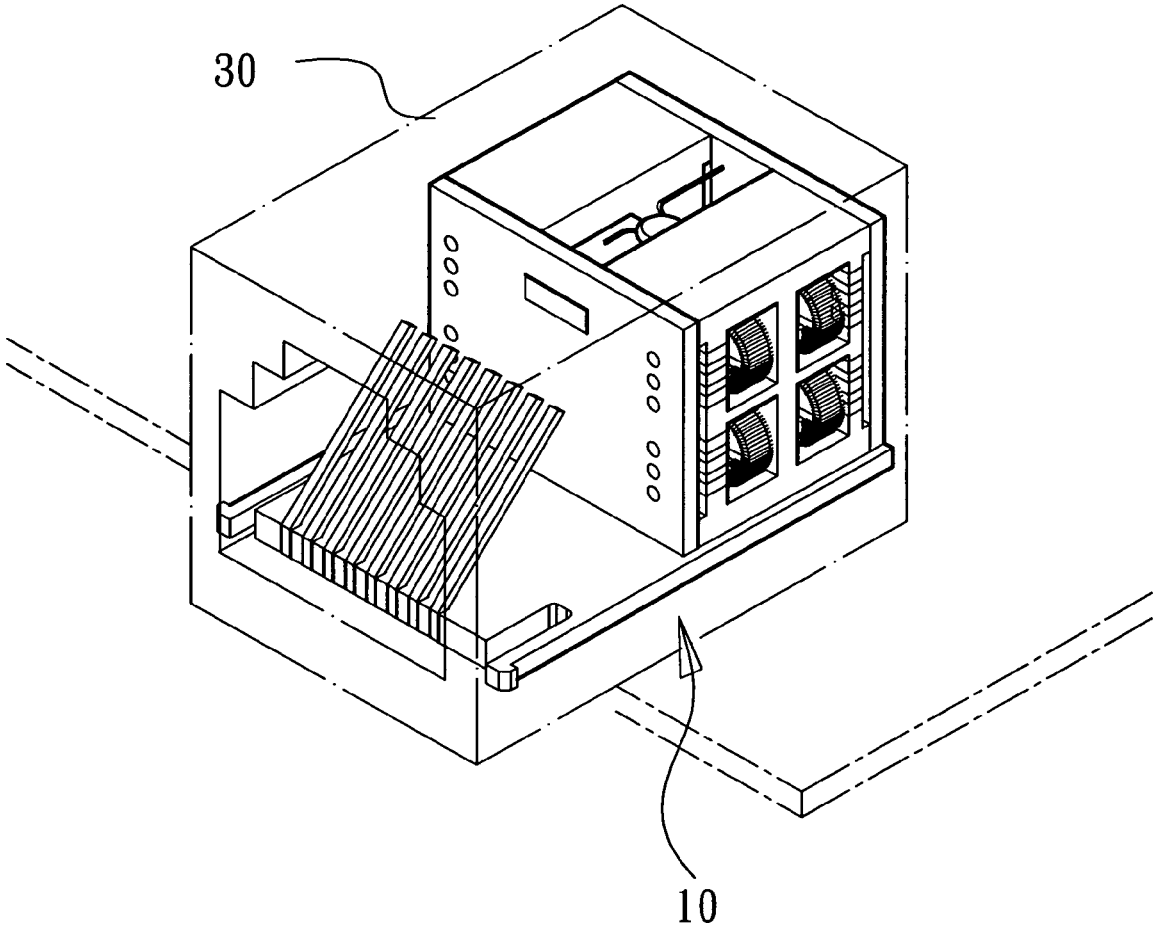
FIG. 1 is a perspective view of a preferred embodiment of the present invention.
Figure 2:
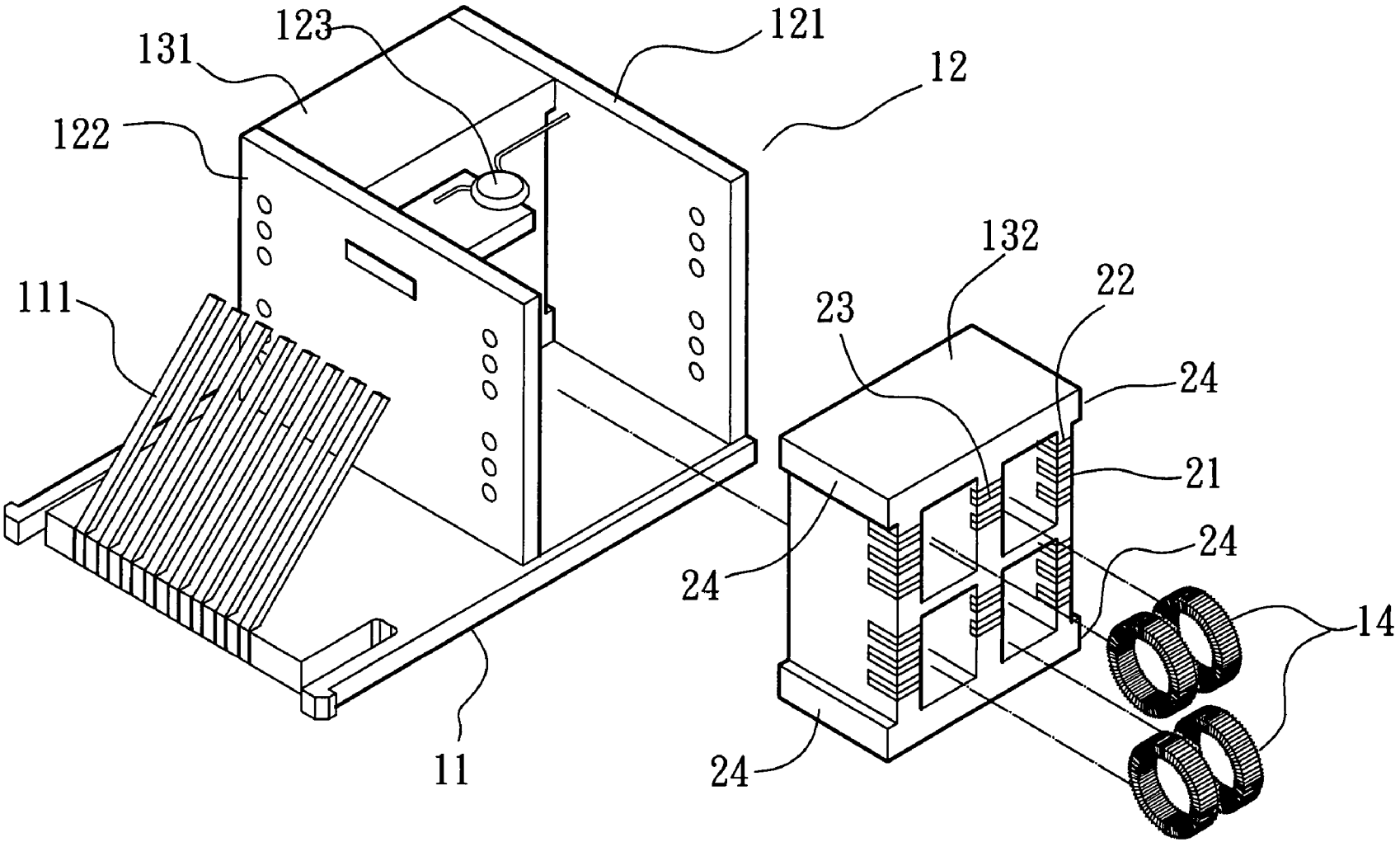
FIG. 2 is an analytic perspective view showing the elements in the internal structure of the present invention.
Figure 3:
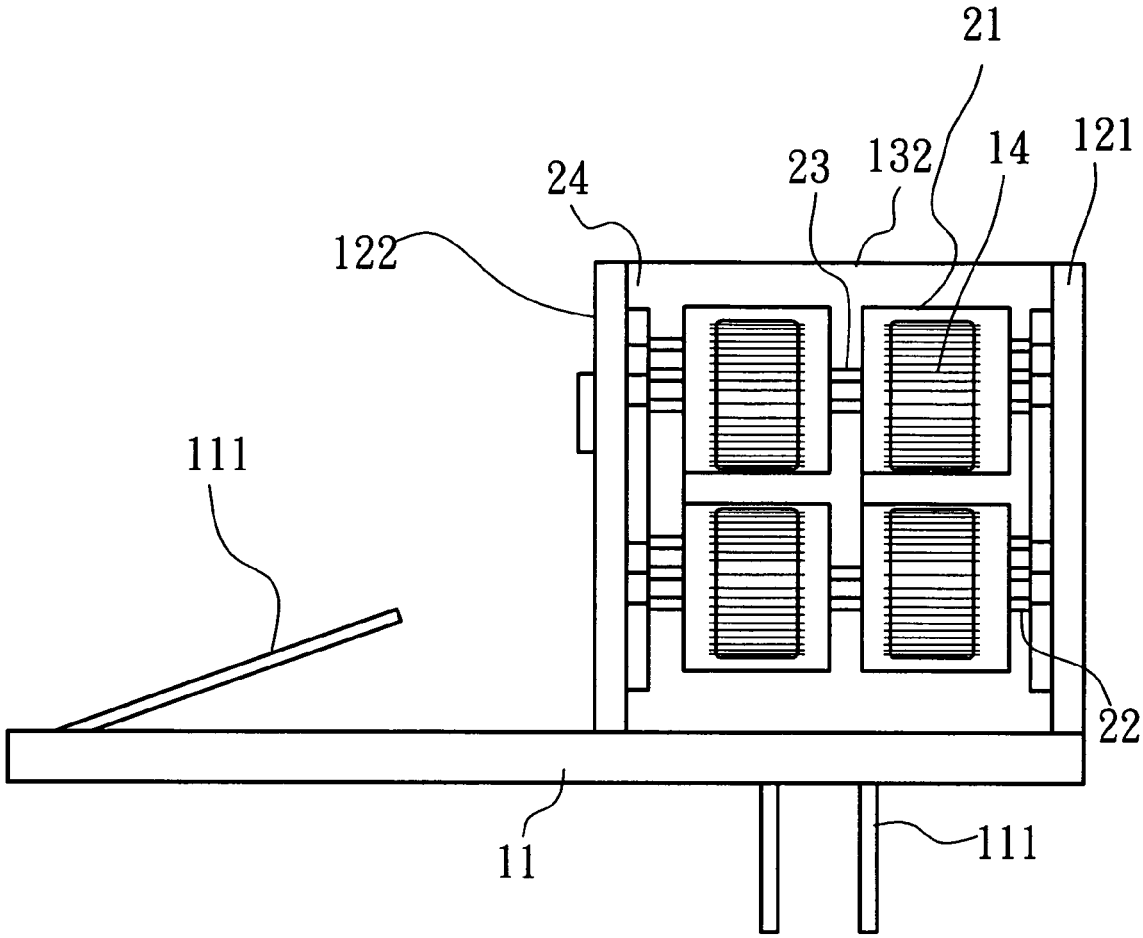
FIG. 3 is a front sectional view showing the internal structure of the present invention.
Figure 4:
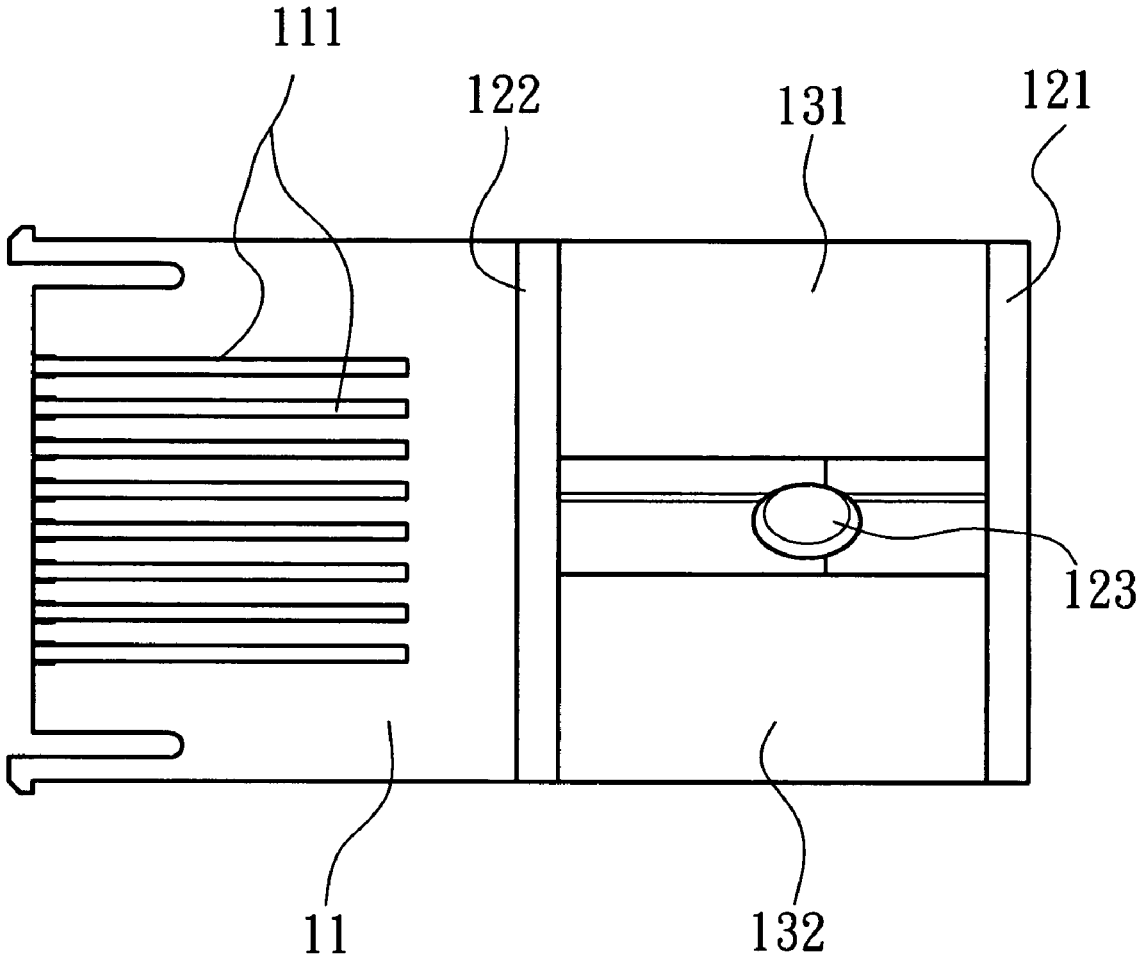
FIG. 4 is a top sectional view showing the internal structure of the present invention.

Referring to FIGS. 2–4, the internal structure 10 of the present invention mainly has a lateral connecting board 11 which is provided thereon in advance with a plurality of metallic guide pins (electrical contacts) 111; in a network-card connector such as RJ45 used at the present time, there are eight guide pins (electrical contacts) 111. The lateral connecting board 11 is provided thereon at one side of it with a circuit board assembly 12 having a resistance-capacitance (RC) element 123.

The circuit board assembly 12 is composed, in addition to the resistance-capacitance (RC) element 123, of a first circuit board 121 and a second circuit board 122. The first and the second circuit boards 121, 122 are spaced away and vertically provided on and at one side of the lateral connecting board 11. The metallic guide pins (electrical contacts) 111 on the lateral connecting board 11 are all electrically connected with the second circuit board 122.

It is important thing of the present invention that, two nest-typed positioning seats 131, 132 for receiving coils 14 are provided between the first and the second circuit boards 121, 122. While the resistance-capacitance (RC) element 123 straddling the first and the second circuit boards 121, 122 is exactly allocated between the two mutually opposite lateral inner sides of the first and the second circuit boards 121, 122, this can reduce the volume of the entire connector.

One thing worth mentioning, the first and the second circuit boards 121, 122 and the two nest-typed positioning seats 131, 132 form a cubic contour. This renders the coils 14 to be very easily assembled in the nests of the positioning seats 131, 132 and connected with the first and the second circuit boards 121, 122; and such a structure with a cubic contour can be very easily assembled and fixed on the lateral connecting board 11.

Certainly, as shown in FIG. 2, the mutually separated positioning seats 131, 132 respectively have four nests 21; this is designed for the two positioning seats 131, 132 with eight metallic guide pins (electrical contacts) 111. And slits 22, 23 with different depths are provided on the periphery of each nest 21, between the nest 21 and another nest 21, and between the nest 21 and an external edge of the seats 131, 132, so that connecting lines of coils 14 can be extended through the slits 22 or 23 to make electric connecting with the first circuit board 121 or the second circuit board 122. This is similar to the structure of the above stated preceding applications being regarded as a prior art.

Number of the nest-typed positioning seats of the present invention is not limited to two, in pursuance of requirement, the number of the nest-typed positioning seats mounted between the first and the second circuit boards 121, 122 can be increased, but it is preferred that the nest-typed positioning seats form a cubic contour with the first and the second circuit boards 121, 122, so that they can be assembled on the lateral connecting board 11 conveniently. And the number of the nests 21 can also be adjusted in pursuance of requirement; they are not limited to four.

Number of the nest-typed positioning seats of the present invention can be one, but it is designed to have therein eight nests for mounting coils, this is an alternative of the present invention and also falls in the scope of the present invention.

Referring to FIGS. 2 and 3, contact areas of the positioning seat 132 of the present invention contacting with the first and the second circuit boards 121, 122 form flanges 24, thereby space for welding spots can be provided for the coils 14 and the first and the second circuit boards 121, 122, In order to reduce the space for arranging the coils 14, the nests 21 on the positioning seat 132 are square, so that the coils 14 can be mounted in the square nests 21 of the positioning seat 132 along a radial direction.

Figure 5:
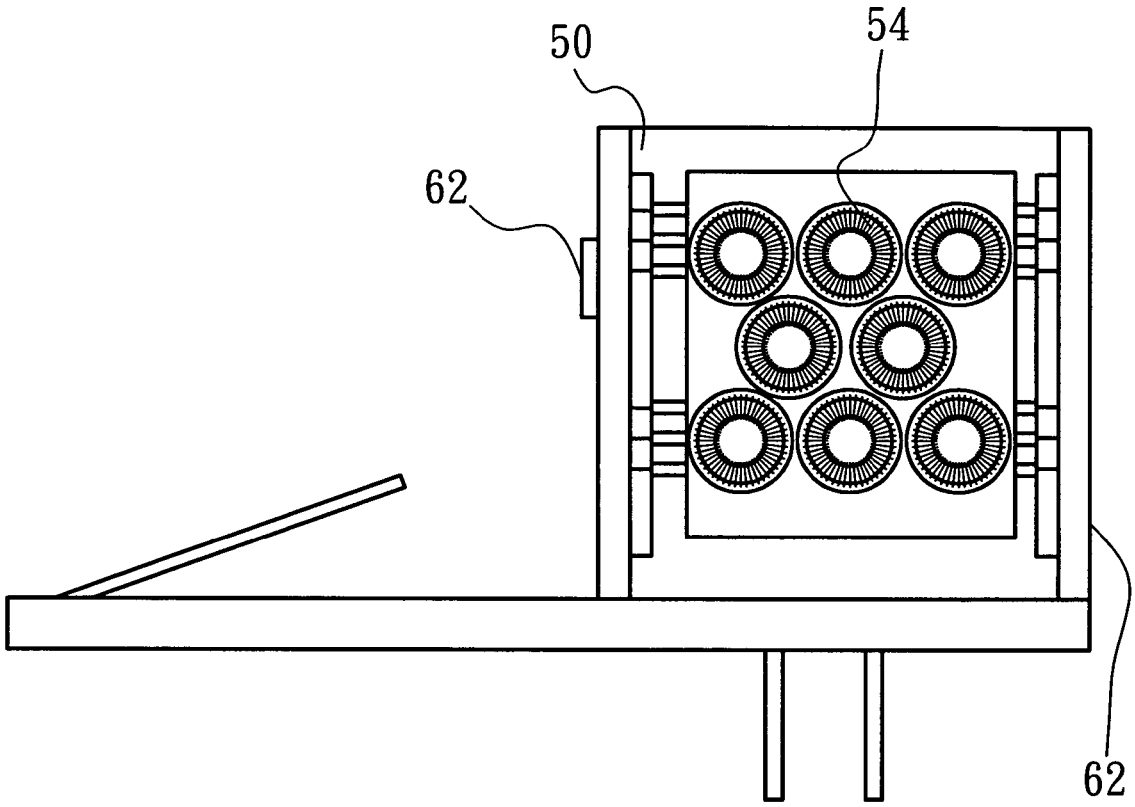
FIG. 5 is a sectional side view of another embodiment of the present invention.

And more, referring to FIG. 5, a positioning seat 50 of the present invention is in the form of a frame which is a square frame in the drawing; coils 54 are received in the frame, they can be tidily or randomly arranged, but their connecting lines are pulled to the outside of the positioning seat 50 to form a structure as a module of the coils 54, this can get a principal effect of conveniently connecting with a circuit board assembly 62.

The internal structure of a connector with at least a coil positioning seat of the present invention surely can get the effect of easy assembling and sure separation, particularly it is evidently advanced technically over the conventional method in the number of metallic guide pins (electrical contacts) used in pursuance of variation of structure design. Having thus described the technical structure of my invention with practicability and improvement, what I claim as new and desire to be secured by Letters Patent of the United States are:

What is claimed is:

1. An internal structure for a connector with at least a coil positioning seat, said internal structure is covered with a metallic housing to form said connector for communication, and comprises:

a lateral connecting board which is provided thereon with a plurality of metallic electrical contacts;

a circuit board assembly having a resistance-capacitance (RC) element and at least a first circuit board and a second circuit board being spaced away and both vertically provided on and at one side of said lateral connecting board, said metallic electrical contacts are electrically connected with one of said circuit boards; and said positioning seat provided between said first and said second circuit boards for receiving coils, connecting lines of all said coils are pulled to one side of said circuit board assembly to be fast connected and to get a function of wave filtering and abnormal voltage isolating.

2. The internal structure for a connector with at least a coil positioning seat as claimed in claim 1, wherein each said positioning seat is of a type having nests, and has a surface on an outer side thereof shaped in advance to have a plurality of mutually spaced nests mating in number with said coils; slits with different depths are provided on the periphery of each of said nests, between said nest and another of said nests, and between each of said nests and an external edge of each said positioning seat; said coils are respectively mounted in said mutually spaced nests of each said positioning seat, and connecting lines of said coils are connected with said circuit board assembly via said slits.

3. The internal structure for a connector with at least a coil positioning seat as claimed in claim 1, wherein number of said at least a positioning seat of said type having said nests is two, said two positioning seats are spaced away and provided between said first circuit board and said second circuit board.

4. The internal structure for a connector with at least a coil positioning seat as claimed in claim 1, wherein said first and second circuit boards and said at least a nest-typed positioning seat provided between said circuit boards form a cubic contour.

5. The internal structure for a connector with at least a coil positioning seat as claimed in claim 1, wherein said contact areas of said at least a nest-typed positioning seat and said first and second circuit boards form flanges, thereby space for welding spots is provided for said coils and said first and second circuit boards.

6. The internal structure for a connector with at least a coil positioning seat as claimed in claim 2, wherein said coils are mounted in said nests of said positioning seat along a radial direction.

7. The internal structure for a connector with at least a coil positioning seat as claimed in claim 3, wherein said resistance-capacitance (RC) element straddles said first and second circuit boards and is allocated between two mutually opposite lateral inner sides of said first and second circuit boards.

* * * * *